US005392835A

United States Patent [19]

Wildt

[11] Patent Number: 5,392,835

[45] Date of Patent: Feb. 28, 1995

[54] ROLL-TYPE INSECT SCREEN ASSEMBLY

[75] Inventor: Adolf Wildt, Iffeldorf, Germany

[73] Assignee: Irowi-Insektenschutz-Rollgitter GmbH, Germany

[21] Appl. No.: 80,336

[22] Filed: Jun. 22, 1993

[30] Foreign Application Priority Data

Apr. 7, 1993 [DE] Germany ..... 4311415.6
Apr. 7, 1993 [DE] Germany ..... 4311416.4

[51] Int. Cl.[6] ..... E06B 9/17
[52] U.S. Cl. ..... 160/269; 160/120
[58] Field of Search ..... 160/269, 273.1, 41, 160/40, 42, 133, 23.1, 11, 271, 272, 311, 120

[56] References Cited

U.S. PATENT DOCUMENTS 1,395,492 11/1921 Guggenberger ..... 160/273.1 X
1,713,989 5/1929 Warnick ..... 160/269
1,756,496 4/1930 Warnick ..... 160/269
1,781,401 11/1930 Lane ..... 160/269
2,509,398 5/1950 Peremi et al. ..... 160/41 X
2,845,117 7/1958 Barry ..... 160/269
2,886,103 5/1959 Pitcoff ..... 160/269
3,231,006 1/1966 Fisher et al. ..... 160/269 X
3,516,471 6/1970 Harkins et al. ..... 160/40
4,237,956 12/1980 Sivin et al. ..... 160/133 X
4,357,978 11/1982 Keller et al. ..... 160/41

*Primary Examiner*—David M. Purol
*Attorney, Agent, or Firm*—Juettner Pyle Lloyd & Piontek

[57] ABSTRACT

A roll-type screen assembly is provided with lateral guide rails adjacent the sides of an opening with a window or door. The guide rails guide the lateral edges of the screen and contain an inflatable tube along the length thereof. A small hand pump with a release valve is employed to releasably lock the edges of the screen.

11 Claims, 7 Drawing Sheets

ROLL-TYPE INSECT SCREEN ASSEMBLY

BACKGROUND OF THE INVENTION

This invention relates to a roll-type insect screen assembly for covering a window or door opening in an insect-proof and air-permeable manner. The assembly comprises a flexible, preferably netlike insect screen which is guided in lateral guide rails mounted on the outside of the opening and which is adapted to be wound onto a roller. The roller is rotatably supported above the opening and is rotatable by means of an actuating device and adapted to be locked in a given rotary position. The assembly includes a weight bar at the lower end of the insect screen, with the weight bar having sufficient weight to cause the insect screen to automatically unwind upon release of the roller.

Various kinds of roll-type insect screen assemblies in the form of automatic blinds are known. As far as automatic blinds are concerned, the roller is connected to a torsion spring which is stretched when the insect screen is unwound, so that the insect screen can be wound up by resilient force. Automatic blinds have the disadvantage that they must be secured in the unwound position. This can be effected by means of a bar which is secured to the lower end of the insect screen and is snapped into a holding device mounted on the window sill. Prior to the rewinding of such insect screen, the screen must be unlocked, which is troublesome and might even be dangerous when performed by children or elderly people who have to lean out of the window for this purpose. Another disadvantage of automatic blinds is that the resilient force of the torsion spring diminishes after a relatively short service life, so that the unwound insect screen can no longer be stretched to a sufficient degree to ensure perfect covering of a window or door opening. Also, the automatic restoring effect is impaired. Furthermore, it is difficult to secure the bar mounted on the lower end of the insect screen to the window sill or door threshold in such a way that an insect-proof covering is ensured.

Roll-type insect screen assemblies are also known wherein the insect screen is pulled upwards and rolled up by hand by means of a pull strap or a pull cord which is unwound from a pull roll connected to the roller and possibly wound onto a counter-roll. The insect screen is made of thin, light weight gauze, is mounted in lateral guides for an insect-proof covering of the building opening. A pull cord, attached to the lower bar of the screen, is manually pulled to unwind the screen from the roller. Hence, it is also troublesome to handle roll screen assemblies of this type. Another disadvantage of such a roll-type insect screen assembly, which can be wound in the manner of a roller shutter, is that the screen is hardly stretched in the unwound state because of its light weight, so that special precautions have to be taken to prevent the thin gauze from being torn out of the lateral guide rails because of wind gusts. Despite all of these efforts, the gauze which is minimally stretched in the longitudinal direction of the insect screen will flap in a breeze, which is undesirable and impairs the service life of the gauze.

DE-OS 28 39 490 and DE-GM 18 20 012 disclose roll-type insect screen assemblies in which the lower end of the screen curtain roll is connected to a bar. The bar has sufficient weight to automatically pull the gauze curtain downward when the associated roll is unlocked. The weight bar is made from wood or metal, requiring a great cross-sectional dimension, to have sufficient weight. These screen assemblies, however, cannot be used in combination with an existing roller shutter because the lateral guide rails of the insect screen have to be arranged between the shutter and the window. The already known roll-type insect screen assemblies cannot be accommodated in this limited space. Moreover, insects may enter into the grooves of the guide rails and hence into the interior of the building.

US-PS 25 48 040 discloses an insect blind for windows having a lower bar on which guide pins of a considerable thickness are arranged and project beyond a plastic film which is provided as a cover. The exclusion of insects around the sides is also not possible with this configuration.

Although DE-GM 85 05 858 shows the possibility of mounting a lower flat section on a screen curtain, the necessary weight is insufficient for unwinding the anti-fly curtain automatically.

DE-GM 18 64 087 discloses a deformable cover strip as a lower end of an insect-screen roller shutter, the cover strip being adapted to be put on a window sill. This configuration has the disadvantage that the strip cannot adapt to irregularities of the contact surface to prevent entry of insects.

DE 39 36 343 C2 of A. Wildt, for which an application was filed Nov. 2, 1989, describes a roll-type insect screen assembly which ensures a virtually fully insect-proof covering of a window or door opening, the insect screen assembly being adapted to be combined with an already existing roller shutter.

In accordance with the above publication, the weight bar at the bottom of the screen consists entirely or partly of lead, and the weight thereof is at least 1 kg/m. With such a weight it is possible to overcome all sliding frictional forces between the screen edges and the lateral guide rails, so that the insect screen unwinds automatically and in an entirely smooth way. Also, the screen is held in such a taut state during the unwinding operation that the frictional forces acting from the guide rails onto the lateral edge portions are minimized. As a result of the vigorously stretched state of the insect screen, even great wind forces cannot make the lateral edge portions detach from the guide rails. Flapping of the netlike gauze is prevented.

Moreover, the weight of the bar ensures that the insect screen will be tightly wound onto the associated screen reel or roller, resulting in a compact coil of a very small diameter. It is, therefore, possible to accommodate the screen roller assembly in an existing roller shutter casing because the small space required by the assembly and operation of the device.

As a result of the material employed in the bar, the necessary weight can be achieved with a bar having only a height of about 25 mm at a width of 10 mm. It is thus possible to install the roll-type insect screen assembly in addition to an already existing roller shutter because the weight bar can be accommodated in a very small space between the roller shutter and the window or between the guide rails of the roller shutter and the architecture of the window or door.

Preferably, the lower end of the insect screen is mounted on a guide rail which is accommodated in a groove of the weight bar and projects at both sides, the weight bar being slightly shorter than the clearance between the lateral guide rails. The weight bar transmits its weight via the guide rail to the screen over the whole width thereof, in order to fully stretch the edges.

To provide additional protection against insects, an elastically deformable bristle strip is provided on the window sill or other opening and is engaged by the weight bar when the screen is closed. The bristle strip adapts to all uneven spots because of the very great number of deformable bristles, and a perfect seal against insets is ensured. Since the bristles can be bent easily and are resilient, even irregular recesses in a contact area are sealed against the entry of insects. The high weight of the bar insures that the screen will remain taught while providing a seal with the strip.

SUMMARY OF THE INVENTION

All of the roll-type insect screen assemblies that have so far been known generally provide an insect-free environment, but offer no hinderance to intruders. In the case of an insect screen which automatically unwinds due to a weight bar, one needs only to push the lower weight bar in the lateral guide rails up to a suitable level, whereby the window or door becomes accessible. In the case of an automatic blind the lower bar of the roll-type insect screen need only be disengaged from its snap-type seat, which can also be easily accomplished. The screen can also be returned without evidence of intrusion.

It is, therefore, the object of the present invention to provide a roll-type insect screen assembly that deters unauthorized entry.

The insect screen may consist of a perforated metallic sheet which may communicate with an alarm system. This is also within the scope of the invention.

In previously known roll-type insect screen assemblies, foreign particles such as dust, lint, and dead insects deposit on the insect screen in the course of time, and the screen becomes darker and gradually looses its transparency. The attempt to clean the screen by brushing it with a hand brush becomes difficult because the gauze consists of a resilient flexible material and cannot be held or supported in an efficient way in the unwound state. The only alternative is to remove the screen and either replace or wash the screen.

It is therefore another object of the present invention to provide a roll-type insect screen assembly in which the accumulation of foreign particles is minimized.

The roll-type insect screen assembly includes a clamping means for releasably securing the lateral edge portions of the screen in a locked position. As a consequence, the screen cannot be lifted by an intruder without visible evidence of entry, such as by ripping or cutting. Thus, the screen assembly provides a deterrent to unauthorized entry, especially when the window or door behind the screen is open.

Clamping of the lateral edge portions of the insect screen minimizes the possible tearing out of the screen, while also providing an effective seal against insect intrusion.

The clamping means may be provided with an automatically unwinding insect screen in both an automatic blind and a roll screen assembly. Preferably, the flexible screen is stretched by the weight bar, which also serves to lock the lateral edge portions.

The clamping means is movable between a release and a locking position. The clamping means comprises at least one flexible tube which can be enlarged by the supply of compressed air to firmly press the edge portion of the insect screen against a stop. The stop may comprise a bar made from a rubber or flexible tube.

The expandable tube and the stop may extend substantially over the whole length of the respective guide rail. The rubber tube may be secured or glued to a longitudinal side of the guide rail, while the stop may be mounted on the opposite longitudinal side of the guide rail.

In a preferred embodiment, the guide rail has a substantially rectangular shape including a slot having a width of about 1.3 mm and is defined by two parallel webs.

The distance between the tube in the relaxed state and the bar should at least be as wide as the slot of the guide rail.

The expandable tubes which are closed at their upper end and communicate with a source of compressed air at their lower end. A common source of compressed air may be provided for both tubes through a branching line. The upper ends of the flexible tubes may be closed by a plug or other suitable means.

The source of compressed air may comprise a hand operated pneumatic pressure pump. The pump may be of the bellows type and is small in size due to the small volume of air to be pumped. A check valve is interposed between the pump and flexible tube and is preferably of the push button type to easily allow release of pressure from the inflated tubes. An elbow is employed to connect the pump and valve from the interior of the building to the flexible tube in the guide rail.

The insect screen assembly may include a brush which extends substantially over the entire width of the insect screen and contacts the screen. The brush strip is preferably positioned near the roller on the inner outlet edge of the shutter casing.

The insect screen sweeps along the brush strip or over the whole length or height when being lowered and also when being wound onto the roller. As a consequence, foreign particles are removed from the screen. The brush strip which consists preferably of a strip-like base carrier and dense elastic bristles engages into the netlike or perforated recesses of the insect screen and efficiently maintains the screen fabric in a clean condition. The brush strip preferably mounted on the interior molding of the window or door.

The brush strip may be attached in any desired way, such as by gluing. Preferably, however, a rail secured to the transverse molding and accommodates the base of the brush strip in a clamping seat. This allows the brush strip to be easily removed for the purpose of cleaning or replacement.

As mentioned above, the bristles of the strip-like brush rest on the screen. The screen is slightly deflected by the brush to assure good contact and removal of debris.

The brush strip preferably has a contact width of about 1 to 2 cm and the bristles of the brush preferably have a length of about 5–15 mm. The bristles may be composed of a flexible plastic material. Thus, the brush strip does not unduly interfere or resist the winding and unwinding operations of the screen.

In addition to the interior brush strip, a second brush strip may be mounted at a suitable location to clean the outside surface of the screen.

In addition to the cleaning operation, the interior brush strip prevents entry of insets between the window molding and the screen and minimizes drafts through this space.

Due to this simple measure, the insect screen is kept clean and transparent over a long period of time. Furthermore, any gaps through the window or door opening are efficiently sealed to insects that have entered into the roller shutter casing, as well as drafts.

DESCRIPTION OF THE PREFERRED EMBODIMENTS

Figure 1:
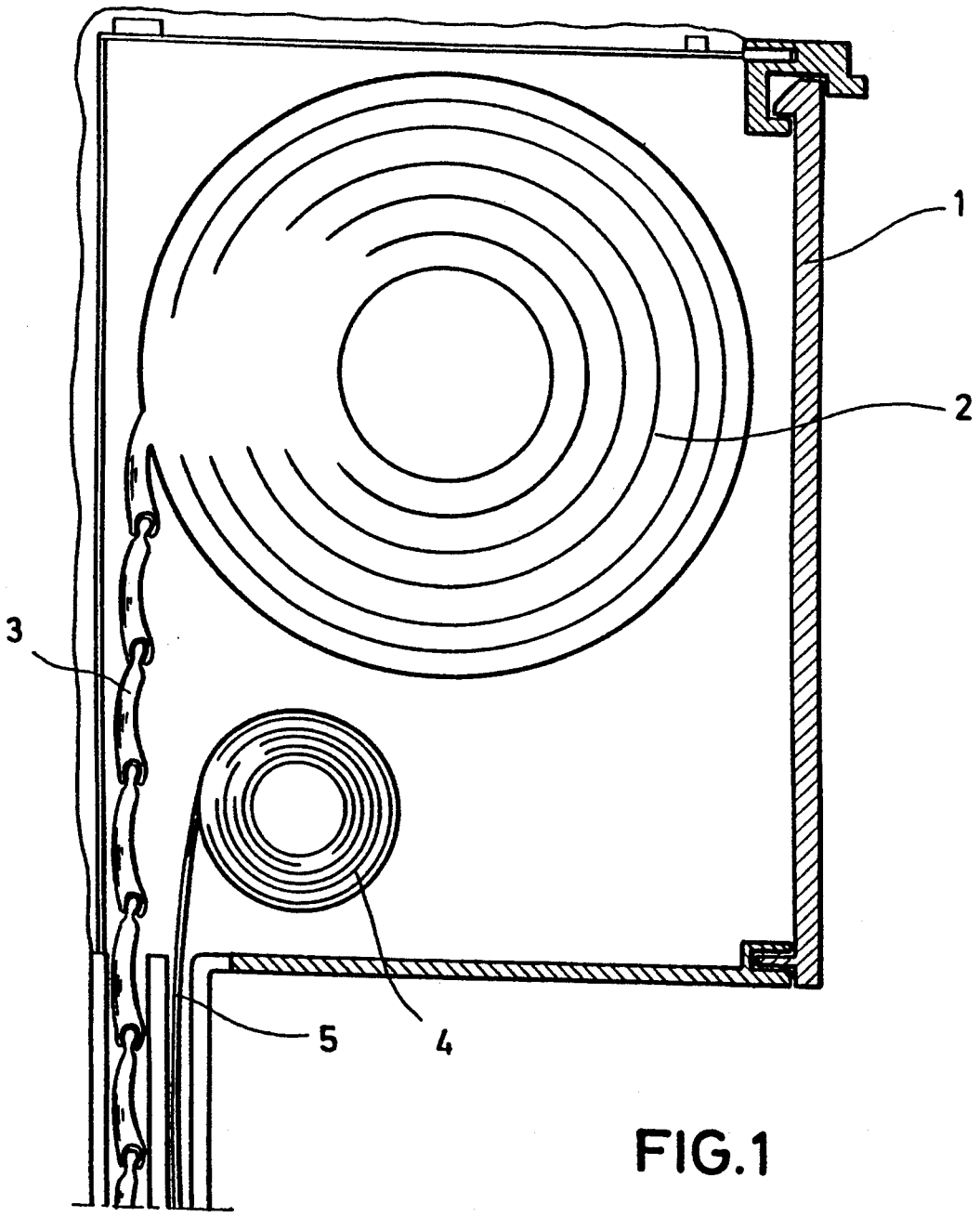
FIG.1 (PRIOR ART)
FIG. 1 is a section through a roller shutter casing in which a roller for an insect screen is installed, in accordance with the prior art.

FIG. 1 shows a conventional roller shutter casing 1 in which a roller 2 of a large diameter is arranged for a roller shutter 3. Below the roller 2, there is sufficient space in the conventional roller shutter casing 1 for disposing another roller 4 for an insect screen 5 which is made of gauze and therefore very thin. The roller 4 has a very small diameter because screen fabric 5 is tightly wound. The two rollers are constructed and supported by their ends in a conventional manner.

Figure 2:
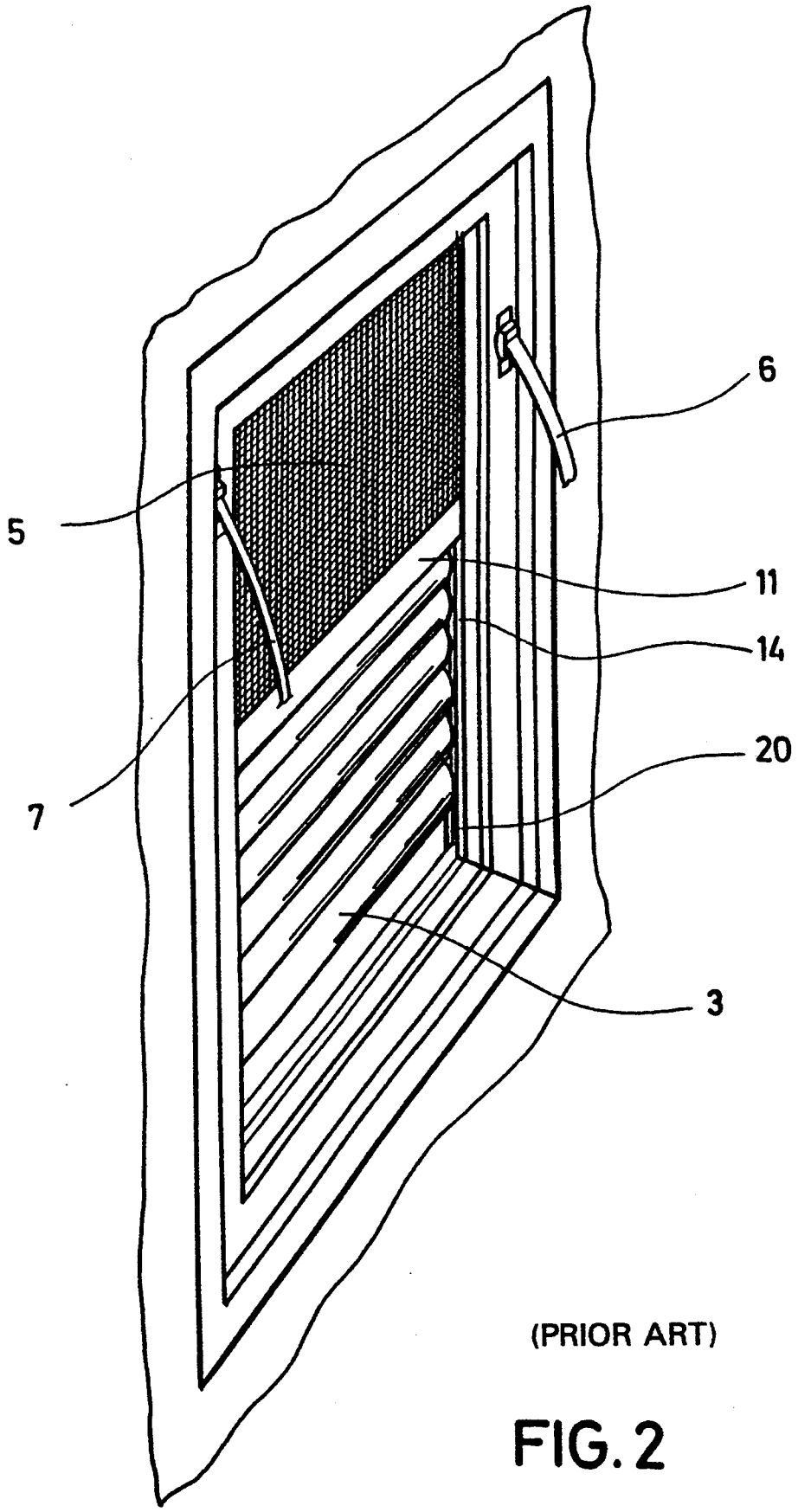
(PRIOR ART) FIG. 2
FIG. 2 is a perspective view of a window which is provided with both a conventional roller shutter and a roll-type insect screen assembly, seen from the inside of a room.

FIG. 2 shows a window which is equipped with the assembly according to FIG. 1. A strap 6 which is wound onto a pull roll (not shown) and connected to the roller 2 is provided for operating roller shutter 3. A strap 7, which is wound in a corresponding way onto a pull roll (also not shown), is connected to roller 4 for operating an insect screen 5.

As shown in FIGS. 1 and 2, the insect screen 5 is arranged between the roller shutter 3 and the window, so that the lateral guide rails of the insect screen 5 are mounted between the guide rails for the roller shutter 3 and the interior molding of the window.

Figure 3:
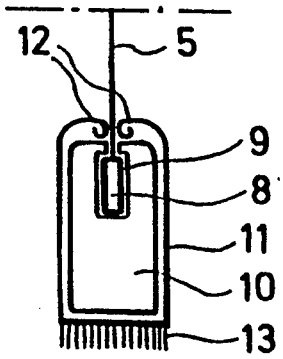
FIG. 3 is a diagrammatic vertical section through an embodiment of a weight bar of the roll-type insect screen assembly in accordance with the prior art.

FIG. 3 illustrates a vertical section through the lower end portion of the insect screen 5. The lower end portion of the insect screen 5 is wound around a guide web 8 having a rectangular cross-section and secured or glued thereto. The guide web 8 is seated in a groove 9 of weight bar 10 consisting of lead, which, in turn, is surrounded by a plastic cover 11. The cover has an upper opening defined by a pair of resilient arms 12 to enable insertion and removal of the weight bar assembly, with the arms in contact with the screen 5.

A bristle strip 13 is mounted on the bottom side of cover 11. The bristles are deformable to allow the weight of weight bar 10 to stretch insect screen 5 after the screen has been lowered and the bristles are in contact with the window sill.

Figure 4:
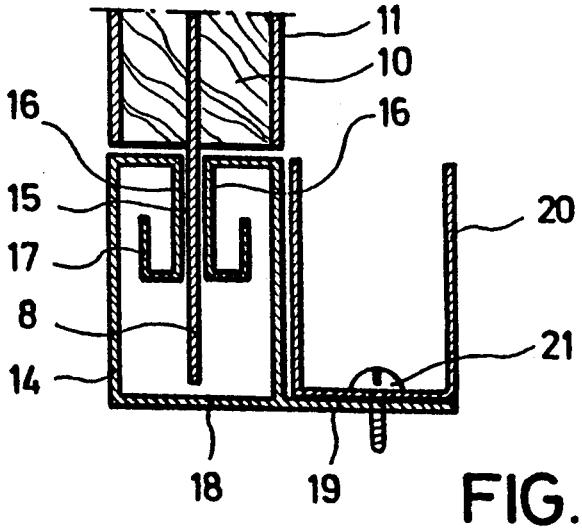
FIG. 4 is a diagrammatic horizontal section through a lateral guide rail and the weight bar of FIG. 3 according to the prior art.

FIG. 4 is a horizontal section through a lateral guide rail 14 which has a slot 15 for the entry of an end section of guide web 8 projecting beyond the weight bar 10 and of the associated edge portion of the screen. Slot 15 is defined by two parallel webs 16 having outer ends 17 bent in a U-shape as shown.

Weight bar 10 terminates a small distance in front of guide rail 14 while guide web 8 extends almost down to the inner wall 18 of guide rail 14.

A lateral flange 19 extends from guide rail 14 and engages against the outer face of a conventional guide rail 20 of a roller shutter 3. The U-shaped guide rail 20 as well as a flange 19 are secured together, such as by the use of screws 21.

Figure 5:
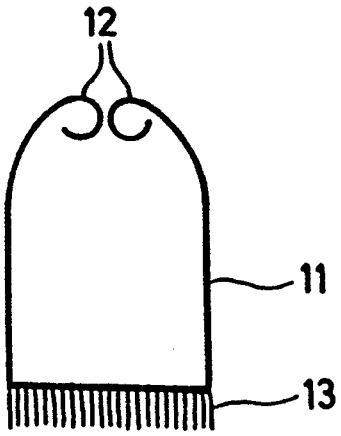
FIG.5 (PRIOR ART)
FIG. 5 is a vertical section through an embodiment of a cover according to the prior art.

FIG. 5 is a diagrammatic vertical section through cover 11 on which the lower bristle strip 13 is molded with very flexible bristles.

Upon installation, as shown in FIG. 3, the spring arms 12 snap together above weight bar 10 and clamp gauze 5 tightly thereinbetween, so that the entry of water is prevented.

Figure 6:
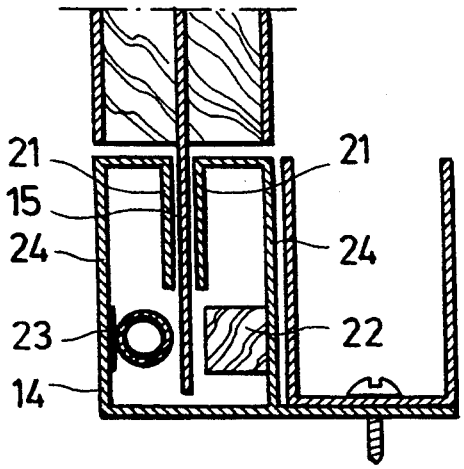
FIG. 6 is a diagrammatic horizontal section similar to FIG. 4, the guide rail being however provided with the clamping means of the invention.

FIG. 6 is a horizontal section through a lateral guide rail 14 which, in contrast to that of FIG. 4, comprises two parallel webs 21 that define slot 15 and whose head ends are not bent. A rubber stop 22 and an expandable tube 23 are mounted in a spaced relationship inside guide rail 14. The two members are adhered to the inner surfaces of the longitudinal sides 24 of guide rail 14. In the pressureless state of tube 23, which is illustrated in FIG. 6, the insect screen is freely movable together with the guide web mounted on the end section thereof between rubber stop 22 and tube 23, whereby it is possible to wind and unwind the insect screen.

Figure 7:
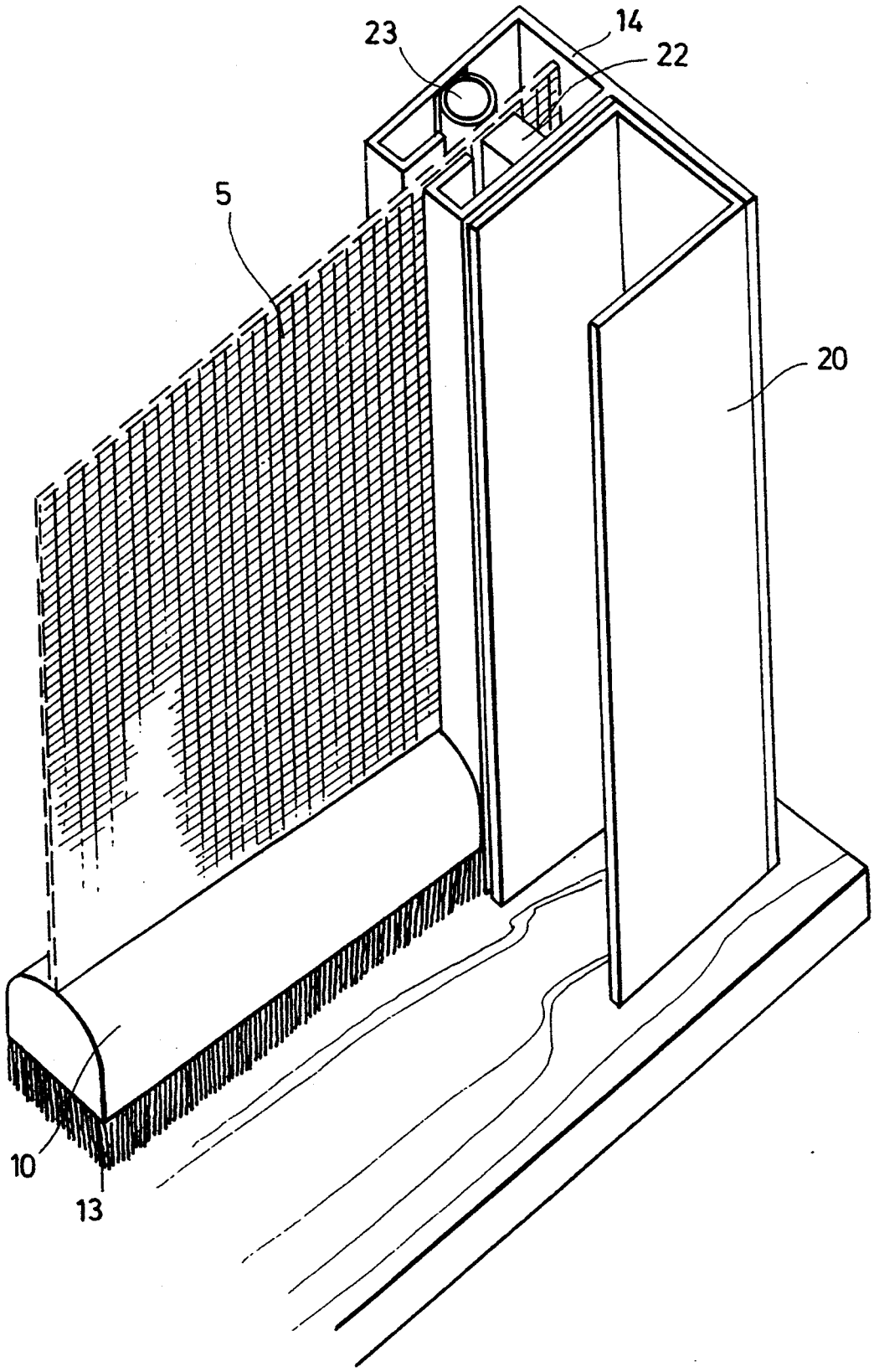
FIG. 7 is a perspective view of the lower end section of the guide rails for the insect screen and a roller shutter.

FIG. 7 illustrates the clamped state of insect screen 5 in which tube 23 is expanded by the supply of compressed air to such an extent that it presses the edge of the screen 5 tightly against rubber stop 22, whereby the screen cannot be pushed upward. Also, the edge portions of the screen remain secure in the guide rails 14 even in case of very great wind forces.

Figure 8:
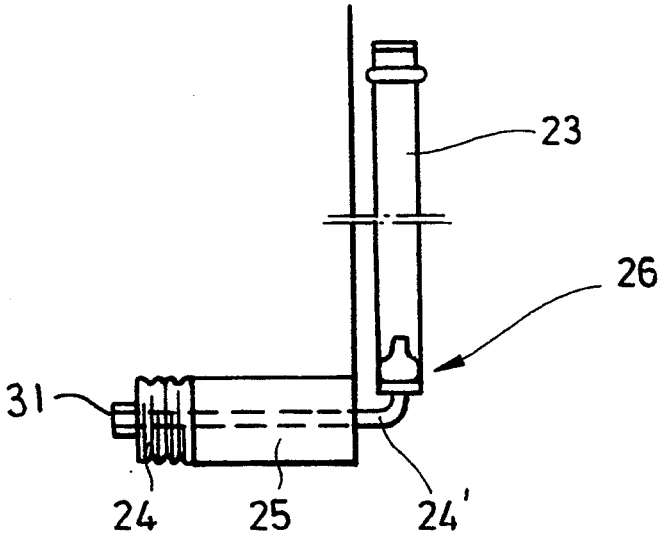
FIG. 8 a diagrammatic representation of the connection of the pressure-expandable tube with a pneumatic pressure pump.

FIG. 8 is a diagrammatic view of the connection of a tube 23 with a pneumatic pump 24 which is mounted on the inside of the window. To this end, a lower elbow 24' is guided through molding 25 and guide rail 14 and inserted into the lower tube opening at 26. The pneumatic pressure pump 24 may have a diameter of a few centimeters, so that it is not very noticeable. The pump is pressed inwards by the thumb in order to introduce compressed air into tube 23 to clamp the screen 5. In order to release the air and raise the screen, a push button check valve 31 is employed.

Figure 9:
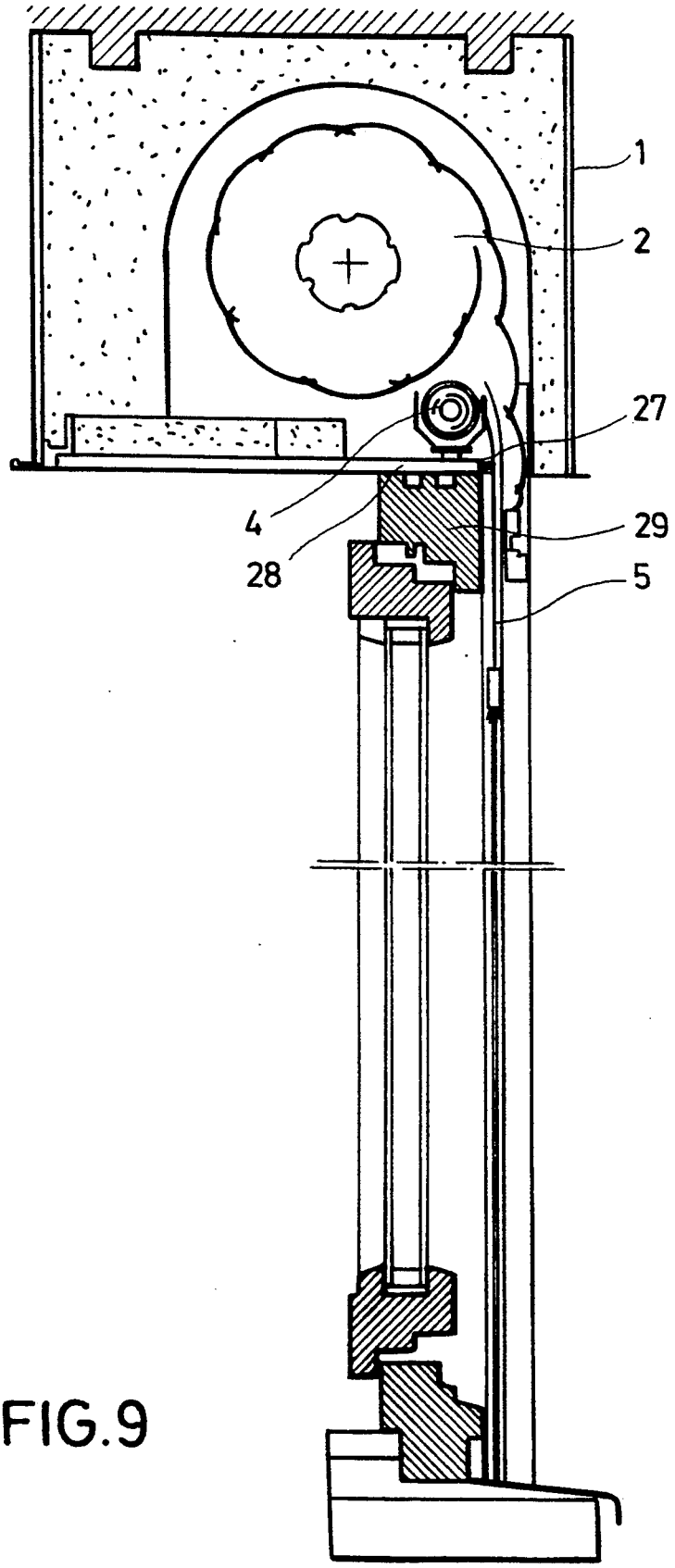
FIG. 9 is a vertical section through a roller shutter casing and the roll-type insect screen assembly comprising the brush strip of the invention.

FIG. 9 shows that a brush strip 27 is mounted in the area of the outer edge of the roller shutter casing in such a way that its resilient bristles rest on screen 5, so that during the upward and downward movement of screen 5 the bristles of the brush strip 27 sweep over the surface thereof and remove any adhering foreign particles. The brush strip 27 constitutes an insect barrier, as it reliably prevents insects which have passed into the roller shutter casing from getting into the interior of the room behind gauze 5 through the window or door opening. Moreover, the brush strip 27 seals and insulates a considerable cross-sectional part of the gap leading into the roller shutter casing.

The brush strip 27 is mounted on the front leading edge of a traverse member 28 which is flush with the front end face of the adjacent molding 29. The bristles of the brush strip 27 project to such an extent that the screen is slightly deflected.

Figure 10:
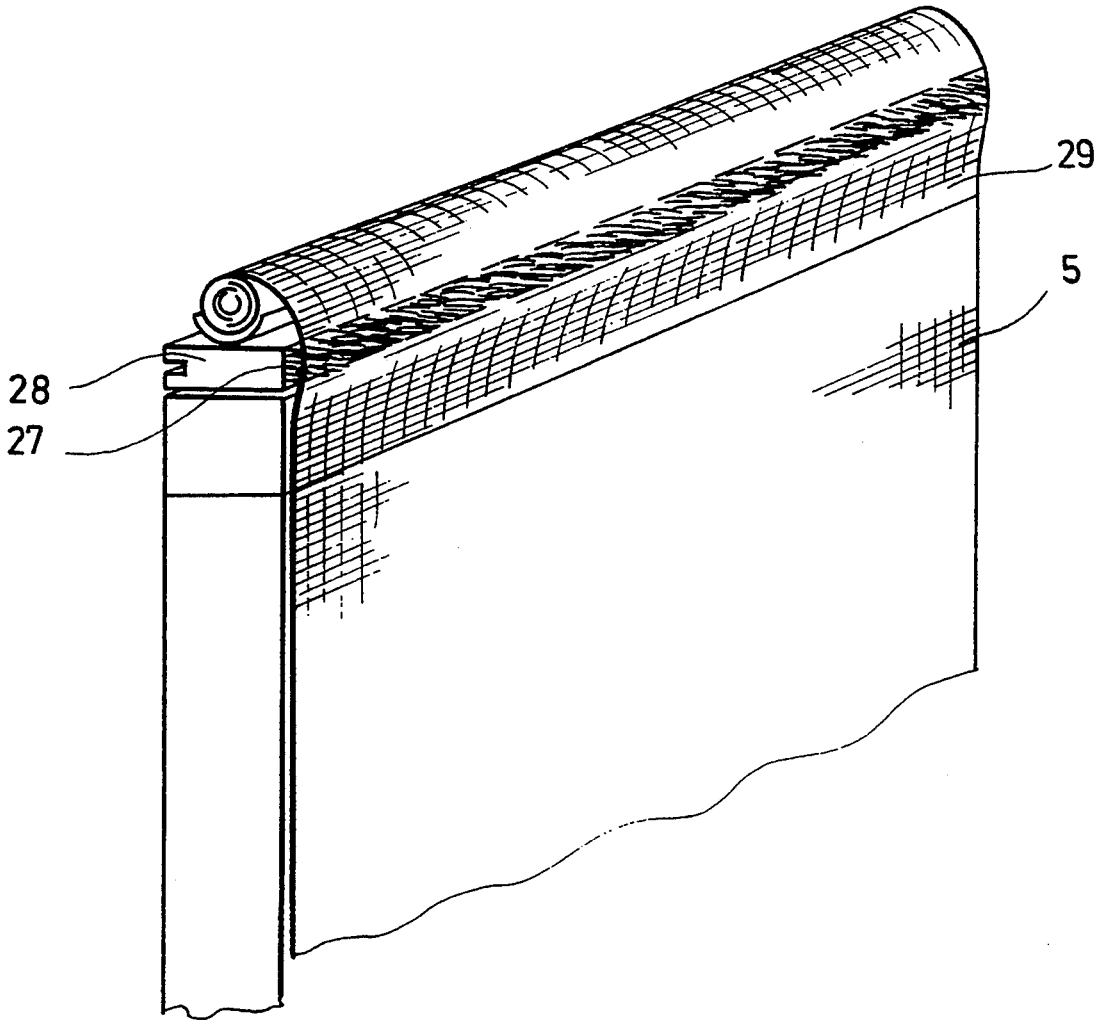
FIG. 10 is a diagrammatic detail view of the insect screen and the brush strip mounted in accordance with FIG. 9.

FIG. 10 shows that the brush strip 27 extends over the whole width of screen 5, so that the latter is cleaned by the brush strip over the whole width as the screen moves up and down.

I claim:

1. A roll-type insect screen assembly, said assembly comprising a pair of lateral guide rails, a screen having lateral edges and first and second sides, said lateral edges being slidably mounted in said guide rails, and clamping means for releasably locking the lateral edges of said screen, said clamping means comprising an elongated flexible pneumatic tube in each of said guide rails adjacent the first side of said screen, a stop in said lateral guide rails adjacent the lateral edges of said screen on the second side thereof, and air supply means connected to said pneumatic tube for releasably supplying compressed air to said pneumatic tubes to releasably clamp the lateral edges of said screen against said stop.

2. The assembly of claim 1 wherein said assembly is installed in an opening having an inside portion, and wherein said assembly additionally comprises an elbow tube having ends, one end being connected to said pneumatic tube, and the other end being connected to the air supply means, said air supply means being located on said inside portion.

3. The assembly of claim 1 wherein said stop is formed of a flexible material.

4. The assembly of claim 1 wherein said stop and flexible pneumatic tube extend substantially the entire length of the guide rail.

5. The assembly of claim 1 wherein each of said guide rails is of substantially rectangular shape and comprises a pair of parallel webs and an inwardly facing slot having sufficient width for freely receiving the lateral edge of the screen, the distance between said stop and said pneumatic tube in a relaxed state being at least as great as said width.

6. The assembly of claim 1 wherein said flexible pneumatic tube has an upper and a lower end, and wherein the upper end of said flexible pneumatic tube is sealed, and the lower end is connected to said air supply means.

7. The assembly of claim 6 wherein said air supply means is a pump.

8. The assembly of claim 7 wherein said pump is hand operated.

9. The assembly of claim 1 additionally comprising valve means for releasing compressed air from said pneumatic tube.

10. The assembly of claim 1 wherein said screen is composed of metal.

11. The assembly of claim 1 additionally comprising a strip-like brush in engagement with said screen over substantially the entire width thereof.

* * * * *